US006736224B2

(12) United States Patent
Kinsella

(10) Patent No.: US 6,736,224 B2
(45) Date of Patent: May 18, 2004

(54) DRILLING SYSTEM AND METHOD SUITABLE FOR CORING AND OTHER PURPOSES

(75) Inventor: Douglas Kinsella, Nisku (CA)

(73) Assignee: Corion Diamond Products Ltd., Alberta (CA)

( * ) Notice: Subject to any disclaimer, the term of this patent is extended or adjusted under 35 U.S.C. 154(b) by 39 days.

(21) Appl. No.: 10/090,998

(22) Filed: Mar. 5, 2002

(65) Prior Publication Data

US 2003/0106717 A1 Jun. 12, 2003

Related U.S. Application Data

(60) Provisional application No. 60/337,204, filed on Dec. 6, 2001.

(51) Int. Cl.[7] ..... E21B 17/042; E21B 10/02; F16L 15/00

(52) U.S. Cl. ..... 175/58; 175/244; 175/320; 285/333

(58) Field of Search ..... 175/58, 244, 320, 175/332, 403; 285/333, 390, 355

(56) References Cited

U.S. PATENT DOCUMENTS

| | | | | | |
|---|---|---|---|---|---|
| 3,565,192 | A | * | 2/1971 | McLarty | 175/246 |
| 3,926,265 | A | * | 12/1975 | Bouyoucos | 173/80 |
| 4,121,862 | A | * | 10/1978 | Greer | 285/333 |
| 4,156,469 | A | * | 5/1979 | Laskey | 175/58 |
| 4,664,204 | A | | 5/1987 | Nenkov | 175/44 |
| 4,679,636 | A | | 7/1987 | Ruhle | 175/58 |
| 4,981,183 | A | * | 1/1991 | Tibbitts | 175/244 |
| 5,148,876 | A | | 9/1992 | Wilson | 175/76 |
| 5,184,495 | A | * | 2/1993 | Chunn et al. | 72/318 |
| 5,188,190 | A | * | 2/1993 | Skaalure | 175/58 |
| 5,286,069 | A | * | 2/1994 | Wilson | 285/114 |
| H1329 | H | * | 7/1994 | Bailey et al. | 285/334 |
| 5,351,765 | A | | 10/1994 | Ormsby | 175/78 |
| 5,419,595 | A | * | 5/1995 | Yamamoto et al. | 285/334 |
| 5,558,476 | A | * | 9/1996 | Uchida et al. | 408/1 R |
| 5,788,401 | A | * | 8/1998 | Drenth | 403/343 |

OTHER PUBLICATIONS

Bourgoyne Jr. et al, Applied Drilling Engineering, 1991, SPE Textbook Series, vol. 2, pp. 19 and 20.*

Smith et al, Titanium Drill Pipe for Ultra–Deep and Deep Directional Drilling, Feb. 27, 2001, SPE/IADC 67722, p. 11.*

Jellison et al, Next Generation Drill Pipe for Extended Reach, Deepwater and Ultra–Deep, 2002, IADC, p. 1.*

* cited by examiner

*Primary Examiner*—David Bagnell
*Assistant Examiner*—Shane Bomar
(74) *Attorney, Agent, or Firm*—Kenneth L. Nash

(57) ABSTRACT

A wellbore assembly is provided that is operable in wellbores in the range of six to six and one-half inches for obtaining large diameter cores, e.g., cores greater than or equal to two and seven-eighths inches in diameter. The wellbore assembly may preferably be utilized with drill pipe so that standard drilling rigs may be utilized in drilling and coring operations therewith. The drill pipe in accord with the present invention may be formed by modifying standard API drill pipe such as API four and one-half inch IF (Internal Flush) drill pipe in a special manner that renders the drill pipe still suitable for the type of drilling operations of interest and also suitable for handling by any drilling rig capable of using standard API drill pipe. Alternatively, the drill piper may be initially manufactured in accord with the specifications of the present invention. The coring tool preferably comprises an inner core barrel for receiving the core and, in a presently preferred embodiment, may be sized to obtain a core having an outer diameter from about three to three and one-half inches.

21 Claims, 2 Drawing Sheets

DRILLING SYSTEM AND METHOD SUITABLE FOR CORING AND OTHER PURPOSES

This application claims benefit of U.S. Provisional Application No. 60/337,204 filed Dec. 6, 2001.

TECHNICAL FIELD

The present invention relates generally to wellbore systems for obtaining cores from wellbores and, more specifically, to system and methods especially suitable for improved drilling operation as well as for obtaining large diameter cores in unconsolidated formations.

BACKGROUND ART

In oil fields with unconsolidated formations, cores are more likely to be washed out or lost prior to retrieval. In such formations, it is desirable to utilize coring tools capable of retrieving larger diameter cores in order to improve the likelihood of obtaining suitable cores. For instance, it is desirable to obtain cores with sufficient mass to permit an analysis of gas and/or hydrocarbon fluid content. Larger diameter core samples are more useful for such purposes.

In order to obtain large diameter cores, e.g., cores greater than two and seven eighths inches in diameter when drilling wellbores diameters in the range of six inches, mining exploration rigs have been utilized in the prior art. The mining industry utilizes a wire line coring system that delivers a two and seven eighths inch core ten feet in length. Mining exploration rigs are hybrids of small service rigs and are primarily meant for shallow soft drilling most often associated with the mining industry as compared to deeper, harder formations of hydrocarbon wells in the oil and gas industry. One of the leading problems of mining exploration rigs that are used to retrieve large diameter cores arises from the use of casing as the drill string rather than standard API drill pipe. Standard API drill pipe does not have a large enough inner diameter to obtain the size cores desired. Casing is normally used to case or line the borehole for production of the well and is not desirable for use in drilling. Casing has less torsional strength than drill pipe. When rough drilling conditions are encountered, the casing is likely to twist off thereby resulting in expensive fishing jobs. For instance, casing suitable for coring six and one-quarter inch diameter wellbores may typically have a maximum torque value of about six thousand foot-pounds which is much less than drill pipe. The tensile strength of a casing string is also considerably less than drill pipe and may be in the range of about 300,000 pounds.

Another problem with use of casing for coring operations is that special rig modifications are needed to operate casing strings as compared to standard API drill strings. The mining exploration rigs are generally unsuitable for operating API drill pipe and may typically require an entire rig replacement in order to drill deeper after the coring operation is completed. It is well known that each stand of drill pipe has upsets which may be utilized by drilling rigs whereas the casing does not have upsets. Thus, different gripping equipment, such as dog collars must be used each time casing is used due to the lack of upsets. Use of casing as the drilling string in a coring operation therefore typically requires a specialized core rig which is limited in the amount of weight and torque available for drilling thereby resulting in slower drilling rates than conventional drilling rigs that utilize drill pipe. The rates of drilling may be as much as ten times greater when using drill pipe as compared to casing. Thus, rig costs may be significantly increased when utilizing casing for drilling purposes.

Consequently, there remains a need to provide an improved system for obtaining large diameter cores and/or other wellbore operations without the significantly time consuming and costly disadvantages associated with the use of casing in coring and/or drilling strings. Those of skill in the art will appreciate the present invention which addresses the above and other problems.

SUMMARY OF THE INVENTION

An objective of the present invention is to provide an improved coring and/or drilling assembly and method.

Another objective of an embodiment of this invention is to provide a coring system that may be utilized with a drilling rig capable of handling standard API drill pipe.

These and other objectives, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

Accordingly, the invention comprises, in one embodiment thereof an assembly operable for drilling and/or coring a wellbore and/or other operations. The assembly may comprise one or more elements such as, for instance, a drill pipe having a tubular outer diameter, an upset portion of the drill pipe tubular extending radially outwardly with respect to the tubular outer diameter wherein the upset portion has an outer diameter ranging from five and one-half inches to six and one-half inches, the drill pipe having an inner diameter ranging from three and three-quarter inches to four and three-quarter inches, and a threaded pin connection for the drill pipe adjacent the upset portion wherein the threaded pin connection has an axial length ranging from two and three-quarters to three and three-quarters inches.

The assembly may comprise a tubular outer diameter in the range of about five inches. The assembly may further comprise a coring tool insertable into the drill pipe tubular, and an inner core barrel of the coring tool for receiving a core sample wherein the inner core barrel has an inner diameter greater than two and seven-eighths inches. In another embodiment, the inner core barrel has an inner diameter equal to or greater than three inches. In another embodiment, the inner core barrel has an inner diameter ranging from three inches to three and one-half inches.

The assembly may further comprise a plurality of the drill pipe tubulars threadably connected together to form a drilling string. The drilling string may have a maximum torque value without damaging the drilling string greater than thirty thousand foot pounds. In another embodiment, the maximum torque value is greater than fifty thousand foot pounds. In one embodiment, the drilling string may have a maximum tensile value without damaging the drilling string greater than four hundred thousand pounds. In another embodiment, the drilling string has a maximum tensile value without damaging the drilling string greater than five hundred thousand pounds.

A method for a coring system in accord with the present invention comprises one or more steps such as, for instance, providing a plurality of drill pipe tubulars having a minimum inner diameter greater than or equal to three and three-quarter inches, providing an upset on the drill pipe having a maximum outer diameter less than or equal to six and one-half inches, and providing a coring tool having a core barrel for receiving a core with an outer diameter greater than or equal to two and seven-eighths inches.

The method may further comprise providing a threaded pin adjacent the upset having a maximum axial length of three and three-quarters inches. The method may further comprise providing the barrel axial length is greater than twenty feet. The method may further comprise providing that the drilling string has a maximum torque value without damaging the drilling string of greater than thirty thousand foot pounds. In another embodiment, the maximum torque may be greater than fifty thousand foot pounds. The method may further comprise providing that the drilling string has a maximum tensile value without damaging the drilling string of greater than four hundred thousand pounds.

The method may further comprise providing that the drilling string has a maximum tensile value without damaging the drilling string of greater than five hundred thousand pounds. The method may further comprise providing that the coring tool is wireline retrievable.

In another embodiment an assembly is provided that is operable for coring and/or drilling and/or other operations in a wellbore less than seven inches in diameter comprising one or more elements such as, for instance, a plurality of drill pipe tubulars threadably connectable together wherein each drill pipe tubular having a tubular outer diameter, an upset for each of the drill pipe tubulars having a maximum outer diameter less than or equal to six and one-half inches, and each drill pipe tubular having an inner diameter greater than or equal to three and three-quarter inches.

The assembly may further comprise a threaded pin connection wherein the axial length of the pin may be less than three and three-quarter inches in length. The assembly may further comprise a coring tool with an inner coring barrel for receiving a core having an inner diameter for receiving a core greater than or equal to two and seven-eights inches in diameter.

This summary is not intended to be a limitation with respect to the features of the invention as claimed, and this and other objects can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION OF PREFERRED EMBODIMENTS FOR CARRYING OUT THE INVENTION

Figure 1:
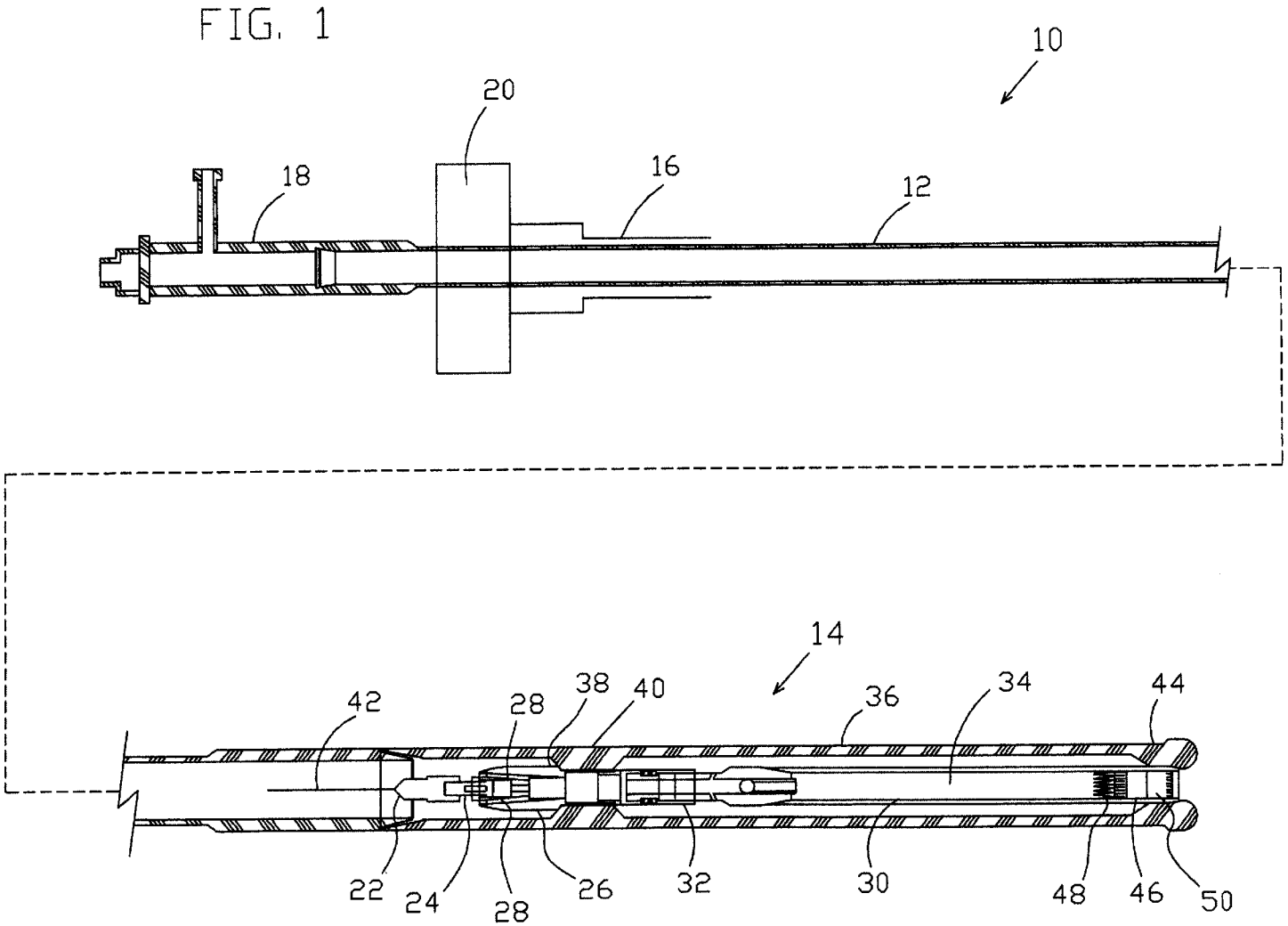
FIG. 1 is an elevational view, in cross-section, showing a coring tool system for obtaining a large diameter core in accord with the present invention.

Referring now to the drawings and, more particularly to FIG. 1 wherein a coring/drilling/wellbore assembly 10 is shown that is suitable for obtaining large diameter cores, e.g., cores with a two and one-half to three and one-half inch diameter, in relatively small diameter holes, e.g., less than seven inches. The system makes use of a drill pipe string 12 in accord with the present invention through which a large diameter inner coring tool assembly 14 may be used. The well bore 16 may be relatively small, typically less than seven inches in diameter, such as six and one-quarter inch diameter.

Drilling fluid may be captured in the mud tanks when using flow diverter 18 which is positioned above rotary table 20 when retrieving coring tool assembly 14 as discussed in more detail subsequently. Rotary table 20 or other suitable means such as a top drive, may be utilized to rotate drill pipe string 12 for coring and/or drilling operations. Drill pipe string 12 comprises a plurality of drill pipes, such as drill pipe 60 of FIG. 2, threadably secured together.

Inner coring tool assembly 14 may be of various constructions but a presently preferred embodiment of inner coring tool assembly 14 is as shown. Inner coring tool assembly 14 may preferably be wireline retrievable. The wireline, such as wireline 42, may be connected by means of rope socket 22.

Various types of latching mechanisms to hold the coring tool 14 in place during drilling may be used such as mechanical latches and/or hydrostatic pressure. In accord with a presently preferred embodiment, bypass valve ring 24 and pressure head 26 with flow passages 28 is designed to create a pressure differential at the top of coring tool 14 with sufficient downward thrust to hold coring tool 14 in position while coring. The size of flow passages 28 may be determined by the strength of the formation being cored. The inner core barrel assembly 30 is rotatably connected to pressure head 26 through bearing assembly 32 such that inner core barrel assembly is free to rotate with respect to pressure head 26. In this way, inner core barrel 30 may remain stationary to keep the core that is received into interior 34 of inner core barrel 30 from twisting off while outer tube 36 rotates with the drill pipe string 12. Hydrostatic pressure forces pressure head 26 to engage shoulder 38 of outer pressure sub 40. Once pressure head 26 engages shoulder 38 a hydrostatic force is created and all or substantially fluid flow through goes through passages 28. The limited diameter of flow passages 28 creates a differential pressure across pressure head 26 that holds pressure head 26 in engagement with shoulder 38 during the coring operation.

During wireline retrieval of the core, bypass valve 22 and bypass ring 24 opens when coring inner assembly 14 is moved through pipe string 12 by wireline 42. Since the outer diameter of pressure head 28 is very close to the inner diameter of drill pipe 12, there is only a small clearance for the drilling fluid to pass by as inner coring tool assembly 14 is retrieved. If the drilling fluid cannot flow past inner coring tool assembly 14, then the retrieval of coring tool 14 by wireline must be slowed. Otherwise, excessive drilling fluid may be swabbed out of the drill pipe. Swabbing creates two potential problems. Fluid being removed from wellbore 16 creates the potential of loss of well control. Normally, the well may be controlled by the hydrostatic pressure of the drilling fluid but such control may be lost if excessive drilling fluid is swabbed from the wellbore. Also, as fluid is swabbed, the pulling load on the wireline increases. If the pressure should increase too much, the wireline connection may break. Typically, the wireline has a weak link or joint, which may typically be adjacent rope socket 22, which is designed to break to protect the wireline from being overly stressed. Bypass valve 22 and bypass valve ring 24 routes the fluid through the internal portion of the assembly and out the low pressure side thereof resulting in less than 2% of the drilling fluid being swabbed.

Core bit 44 may be of various types designed to cut the core and allow the core to enter upper shoe 46. In a preferred embodiment, a retrievable pilot bit may be utilized. Basket catcher 48 and/or spring catcher 50 and/or other types of catchers hold the core inside inner core barrel 30 to prevent the core from dropping out. Inner core barrel 30 may have a length of about thirty feet. The inner diameter of inner tube 30 may preferably be greater than two and seven-eighths inches. In one presently preferred embodiment, the inner diameter is at least three inches and may be up to three and one-half inches in diameter. In a preferred embodiment, inner tube 30 comprises split aluminum halves that may be held together in a steel tubular. Inner tube 30 may preferably have an ID of 3.25 inches and an OD of 3.75 inches. Inner coring tool 14 in accord with the present invention is designed to cut at least a three-inch diameter core which may be at least twenty-four feet in length.

Figure 2:
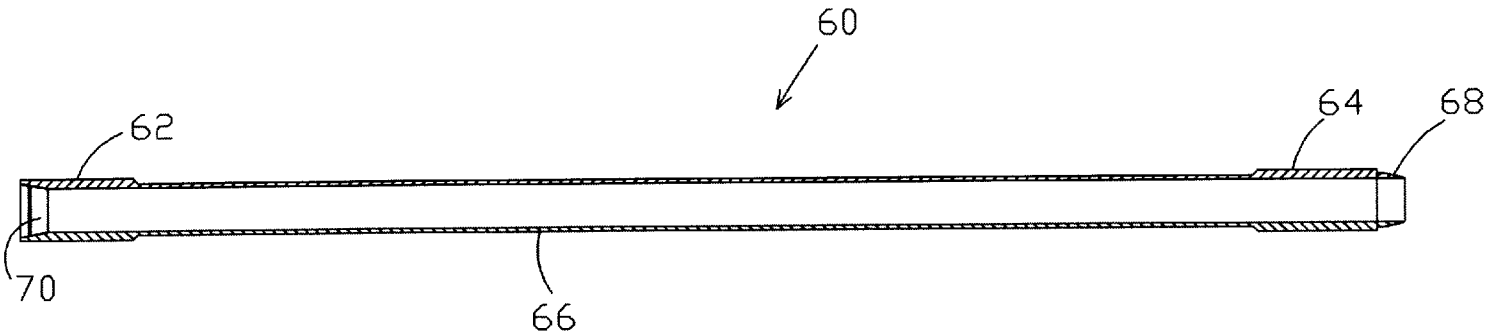
FIG. 2 is an elevational view, in cross-section, showing a five-inch drill pipe.

FIG. 2 shows drill pipe joint 60. Drill pipe joint 60 has an upper upset portion 62 and a lower upset portion 64. An upset portion typically has an increased wall thickness as compared to the wall thickness of center portion 66 that extends over most of drill pipe joint 60. Drill pipe joint 60 is typically about thirty feet in length. A threaded pin section 68 is provided at lower upset 64 and a threaded socket 70 is provided adjacent upper upset portion 62.

In order to use coring tool 14 having an inner core barrel with a large interior diameter of, for instance, three inches, it is necessary to utilize drill pipe that differs from existing API four and one-half inch IF drill pipe. The internal diameter of the connection at the upset portions must be increased to accommodate the passing of coring tool 14 through the threaded connections of drill pipe string 12. In accord with the present invention, the length of pin 68 is thereby decreased to accommodate the increased internal diameter. If necessary, the outer diameter of both the box and pin upset portions may be reduced to five three-quarter inches for the purpose of drilling a six and one-quarter inch hole.

In one embodiment of the invention, standard drill pipe is modified to the dimensions as described herein. In another embodiment of the invention, drill pipe may be originally built to the dimensions as described herein. When modifying standard drill pipe in accord with the present invention, and mechanically changing the dimensions of the connection, the typical use of such drill pipe is changed. The typical use of five inch drill pipe, e.g., drill pipe wherein an outer diameter of section 66 is five inches, is intended for wells with depths greater than about 2000 meters. Five inch drill pipe is used for the additional strength need for drilling deeper wells. Five inch drill pipe is also capable of drilling directional wells, where the drill pipe is physically flexed through an angle as the drill pipe rotates during drilling. The length of pin 68 determines, to a large extent, the bending strength ratio of the connection. The typical ratio needed for directional drilling or deep well drilling is approximately 1:3. After modifying the drill pipe in accord with the present invention, the drill pipe has a bending ratio of about 2.1:3. Therefore, the drill pipe as used in the present invention is preferably used in shallow holes (up to about 1000 meters) and with a limited deviation from the vertical, e.g., less than three degrees.

Figure 3B:
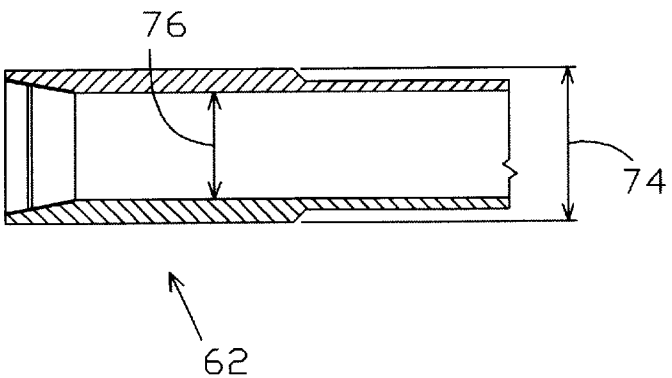
FIG. 3B is an elevational view, in cross-section, showing a female upset end of a drill pipe in accord with the present invention.
Figure 3A:
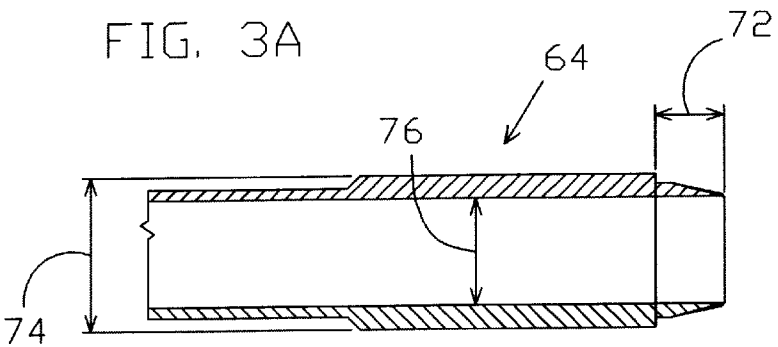
FIG. 3A is an elevational view, in cross-section, showing a male upset end of a drill pipe in accord with the present invention.

FIG. 3A and FIG. 3B illustrate the essential dimensional elements of drill pipe upsets 62 and 64 in accord with the present invention. Pin axial length 72 in accord with the present invention preferably ranges from two and three-quarters inches in length to three and three-quarters inches in length. In a presently preferred embodiment, pin axial length 72 is three and one-quarter inches in length.

Upset outer diameter 74, in a preferred embodiment, ranges from five and one-half inches to six and one-half inches. In a presently preferred embodiment, upset outer diameter 74 is five and three-quarter inches.

Upset internal diameter 76, in a preferred embodiment, ranges from three and three-quarter inches to about four and three-quarter inches. In a presently preferred embodiment, upset inner diameter 76 is four and one-quarter inches.

Normal API four and one-half inch IF connections have a make-up torque of 31,703 ft-lbs. with a torsional yield point at 37,700 ft-lbs. After modification of such drill pipe, the make-up torque is 13,000 ft-pounds and the maximum torsional yield is 21,690 ft-lbs. The torsional yield of casing of the type that has been used in six inch holes for large diameter core retrieval is only about 6,004 ft-lbs. The maximum tensile yield value may be about 314,019 pounds.

In one embodiment of the invention, maximum torque values of suitably dimensioned drill pipe have reached 52,140 ft-lbs with maximum tensile yields of 501,000 pounds.

Thus, in accord with the present invention, a five-inch drill pipe string 12 is modified as discussed above for the drilling string. The well is drilled to core point and the BHA drilling assembly is laid down. Outer core barrel 36 and core bit 44 is picked up and ran into wellbore 16. Once bottom is found and the hole is circulated bottoms up, the kelly (not shown) is racked back exposing the open drill pipe. Once complete inner coring assembly 14, which includes pressure head 26, inner tube 30, and the other inner core assembly components, is picked up and dropped through the top of drill string 12. The assembly may fall at approximately three feet/sec or can be pumped in place if flow rates are below 100 G.P.M. Once inner coring assembly 14 is seated in shoulder 38, there is a significant pressure increase in the fluid indicating that the tool is hydraulically latched (held in position by hydraulic pressure). Coring commences. While coring, the fluid pressure of the drilling fluid should remain constant for a constant flow in gallons per minute within about plus or minus five percent unless the formation core jams in inner assembly 14. Since inner assembly 14 is preferably held in place by the hydrostatic pressure of drilling fluid being pumped through the tool, there may be insufficient force to hold the assembly in place. As a result, if inner assembly 14 is unseated a significant pressure decrease is visible at the surface. The kelly may then be racked back and flow diverter 18 attached to the top of drill string 12. Flow diverter sub 18 diverts drilling fluid to the mud tanks that is swabbed as a result of pulling coring assembly 14 through the drill string. The coring tool assembly 14 is laid out on the cat walk and a second inner coring assembly 14 may be picked up and dropped down the string. This is a cyclical procedure that is repeated until the entire zone of interest is cored. After coring, then normal drilling can commence using the same drill string 12. Alternatively, the coring drill string 12 with the dimensions described above can be laid down and another drill string pick up, if desired. A standard API drilling rig will be able to handle either standard drill pipe or drill pipe 12 as discussed above with little or no changes.

Coring/drilling//wellbore system 10 in accord with the present invention provides a tool that will cut a three-inch diameter core nine meters long in a six and one-quarter inch hole. Drill pipe 12 may be utilized in a wellbore up to at least 1500 meters deep on a conventional drilling rig and using conventional drilling practices. Coring/drilling/wellbore system 10 may be used not only for coring but for drilling without coring and/or other drilling operations or wellbore operations where a large inner diameter drilling string is required that is operable with standard API drilling string couplings.

The foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and still operate well within the spirit of the invention as described hereinbefore and in the appended claims. It will be seen that various changes and alternatives may be used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

It is claimed:

1. An assembly operable for a wellbore, said assembly comprising:

a drill pipe tubular, said drill pipe tubular having a tubular outer diameter;

an upset portion of said drill pipe tubular extending radially outwardly with respect to said tubular outer diameter, said upset portion having an upset outer diameter ranging from five and one-half inches to six and one-half inches, said upset portion having an inner diameter ranging from three and three-quarter inches to four and three-quarter inches and;

a threaded pin connection for said drill pipe tubular adjacent said upset portion, said threaded pin connection having an axial length ranging from two and three-quarters to three and three-quarters inches.

2. The assembly of claim 1, wherein said tubular outer diameter is in the range of about five inches.

3. The assembly of claim 1, further comprising:

a coring tool insertable into said drill pipe tubular, and an inner core barrel of said coring tool for receiving a core sample, said inner core barrel having an inner diameter greater than two and seven-eighths inches.

4. The assembly of claim 3, wherein said inner core barrel has an inner diameter equal to or greater than three inches.

5. The assembly of claim 4, wherein said inner core barrel has an inner diameter ranging from three inches to three and one-half inches.

6. The assembly of claim 1, further comprising:

a plurality of said drill pipe tubulars threadably connected together to form a drilling string, said drilling string having a maximum torque value without damaging said drilling string of greater than thirty thousand foot pounds.

7. The assembly of claim 6, wherein said maximum torque is greater than fifty thousand foot pounds.

8. The assembly of claim 6, wherein said drilling string has a maximum tensile value without damaging said drilling string of greater than four hundred thousand pounds.

9. The assembly of claim 6, wherein said drilling string has a maximum tensile value without damaging said drilling string of greater than five hundred thousand pounds.

10. A method for a wellbore system, comprising:

providing a plurality of drill pipe tubulars having a minimum inner diameter greater or equal to four inches;

providing an upset permanently affixed to each of said drill pipe tubulars such that an outer diameter of said upset is greater than an outer diameter of said plurality of tubulars; and providing that said upset has a maximum outer diameter less than or equal to six and one-half inches.

11. The method of claim 10, further comprising:

providing a threaded pin adjacent said upset having a maximum axial length of three and three-quarters inches.

12. The method of claim 10, further comprising:

providing that a drilling string comprised of said plurality of drill pipe tubulars has a maximum torque value without damaging said drilling string of greater than thirty thousand foot pounds.

13. The method of claim 12, wherein said maximum torque is greater than fifty thousand foot pounds.

14. The method of claim 10, further comprising:

providing that a drilling string comprised of said plurality of drill pipe tubulars has a maximum tensile value without damaging said drilling string of greater than four hundred thousand pounds.

15. The method of claim 10, further comprising:

providing that a drilling string comprised of said plurality of drill pipe tubulars has a maximum tensile value without damaging said drilling string of greater than five hundred thousand pounds.

16. The method of claim 10, further comprising:

providing a coring tool which is retrievable by passing through said drill pipe and having an inner core barrel sized for receiving a core with an outer diameter of greater than or equal to two and seven-eighths inches; and providing that said coring tool is wireline retrievable.

17. A method for a wellbore system for drilling a wellbore less than seven inches in diameter, comprising:

providing a plurality of drill pipe tubulars having a minimum inner diameter greater or equal to four inches;

providing an upset permanently affixed to each of said drill nine tubulars such that an outer diameter of said upset is greater than an outer diameter of said plurality of tubulars;

providing a coring tool having an inner core barrel sized for receiving a core with an outer diameter of greater than or equal to two and seven-eighths inches; and providing that said inner core barrel length is greater than thirty feet.

18. An assembly operable for drilling in a wellbore less than seven inches in diameter, comprising:

a plurality of drill pipe tubulars threadably connectable together for drilling in said wellbore less than seven inches in diameter wherein each drill pipe tubular has a tubular outer diameter;

an upset for each of said drill pipe tubulars having a maximum outer diameter greater than said tubular outer diameter; and each drill pipe tubular having a minimum inner diameter greater than or equal to four inches.

19. The assembly of claim 18, further comprising:

said upset having said maximum outer diameter less than or equal to six and one-half inches.

20. The assembly of claim 18, further comprising:

a threaded pin connection, said threaded pin connection having an axial length less than three and three-quarter inches in length.

21. The assembly of claim 18, further comprising:

a coring tool with an inner core barrel for receiving a core, said inner core barrel having an inner diameter for receiving a core greater than or equal to two and seven-eights inches in diameter.

* * * * *

UNITED STATES PATENT AND TRADEMARK OFFICE

CERTIFICATE OF CORRECTION

PATENT NO. : 6,736,224 B2
DATED : May 18, 2004
INVENTOR(S) : Douglas Kinsella

It is certified that error appears in the above-identified patent and that said Letters Patent is hereby corrected as shown below:

Column 7,
Line 40, delete ";" after "and" and insert -- ; -- after "inches".

Column 8,
Line 48, delete "nine" and replace with -- pipe --.

Signed and Sealed this

Third Day of August, 2004

JON W. DUDAS
*Acting Director of the United States Patent and Trademark Office*